US007733280B2

(12) United States Patent
Cornwell

(10) Patent No.: US 7,733,280 B2
(45) Date of Patent: Jun. 8, 2010

(54) ANTENNA SYSTEM

(75) Inventor: James Cornwell, Ruther Glen, VA (US)

(73) Assignee: Kaonetics Technologies, Inc., Inyokern, CA (US)

( * ) Notice: Subject to any disclaimer, the term of this patent is extended or adjusted under 35 U.S.C. 154(b) by 78 days.

(21) Appl. No.: 11/882,211

(22) Filed: Jul. 31, 2007

(65) Prior Publication Data

US 2008/0024374 A1 Jan. 31, 2008

Related U.S. Application Data

(63) Continuation of application No. PCT/US2006/004779, filed on Feb. 13, 2006.

(60) Provisional application No. 60/651,627, filed on Feb. 11, 2005.

(51) Int. Cl.
*H01Q 21/00* (2006.01)

(52) U.S. Cl. ..... 343/703; 343/731; 343/846

(58) Field of Classification Search ..... 343/700 MS, 343/703, 725, 731, 795, 895, 793, 797, 807, 343/810, 830, 860, 727, 829, 846, 853
See application file for complete search history.

(56) References Cited

U.S. PATENT DOCUMENTS 4,291,312 A * 9/1981 Kaloi ..... 343/700 MS
4,814,777 A * 3/1989 Monser ..... 343/727
5,002,502 A * 3/1991 Hill ..... 439/536
5,864,318 A 1/1999 Cosenza et al.
5,878,327 A * 3/1999 Hayashi et al. ..... 455/41.2
5,986,609 A * 11/1999 Spall ..... 343/702
6,091,364 A * 7/2000 Murakami et al. .... 343/700 MS
6,133,880 A * 10/2000 Grangeat et al. ..... 343/700 MS
6,417,816 B2 * 7/2002 Sadler et al. ..... 343/795
6,424,298 B1 * 7/2002 Nishikawa et al. .... 343/700 MS
6,639,560 B1 * 10/2003 Kadambi et al. ..... 343/700 MS
6,747,605 B2 * 6/2004 Lebaric et al. ..... 343/795
6,836,254 B2 * 12/2004 Kalis et al. ..... 343/770
6,842,158 B2 * 1/2005 Jo et al. ..... 343/895
6,859,176 B2 * 2/2005 Choi ..... 343/700 MS
6,873,298 B1 * 3/2005 Aisenbrey ..... 343/718
6,906,678 B2 * 6/2005 Chen ..... 343/795
7,023,385 B2 * 4/2006 Harihara ..... 343/700 MS
7,518,554 B2 * 4/2009 Bateman et al. ..... 343/700 MS
2003/0076264 A1 * 4/2003 Yuanzhu ..... 343/700 MS
2007/0004363 A1 * 1/2007 Kusaka et al. ..... 455/269
2007/0052593 A1 * 3/2007 Bateman et al. ..... 343/700 MS
2007/0279303 A1 * 12/2007 Schoebel ..... 343/713

* cited by examiner

*Primary Examiner*—Douglas W Owens
*Assistant Examiner*—Chuc D Tran
(74) *Attorney, Agent, or Firm*—Stroock & Stroock & Lavan LLP

(57) ABSTRACT

An antenna system includes plural antennas. Each antenna is different than every other antenna. Each antenna is characterized by a principal plane. A principal plane of a first antenna is oblique to a principal plane of a second antenna. The first antenna includes a first insulating substrate extending in the principal plane of the first antenna. The first antenna further includes a first radiating element and a connected first conductor and includes a second radiating element and a connected second conductor. The first antenna further includes a coupling conductor coupling the second radiating element and the first conductor. The first antenna further includes a first coupler having a first signal conductor and a second signal conductor. The first signal conductor is coupled to the second conductor, and the second signal conductor is coupled to the first radiating element.

13 Claims, 13 Drawing Sheets

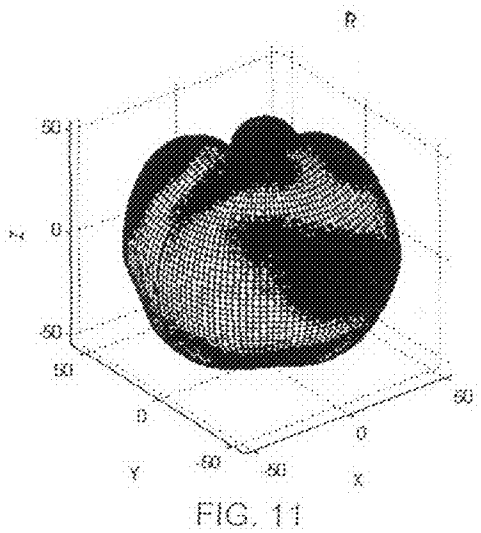
FIG. 11
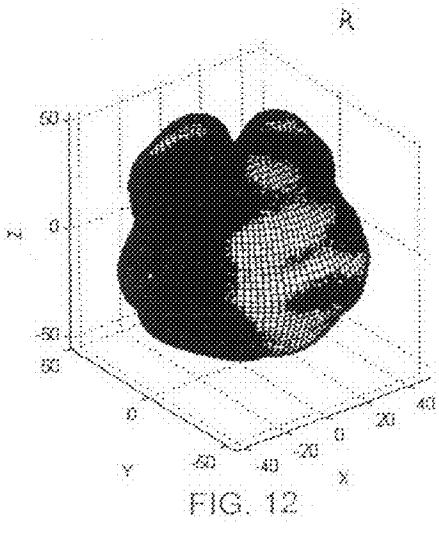
FIG. 12
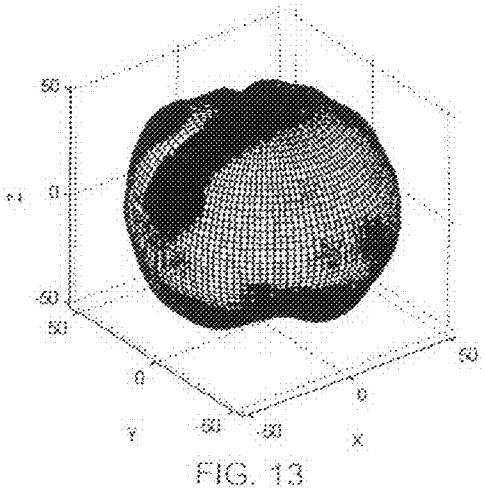
FIG. 13
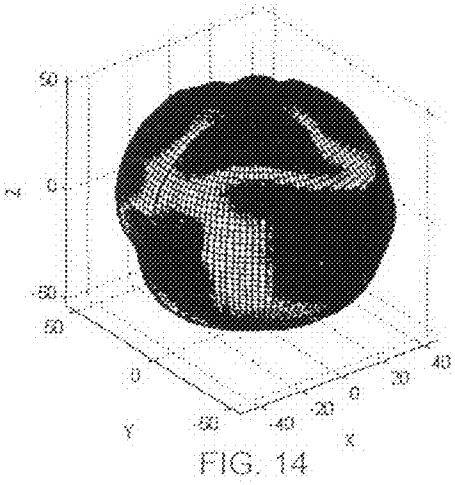
FIG. 14
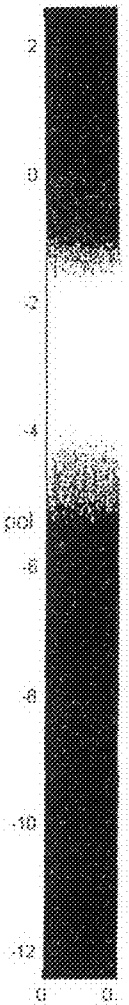

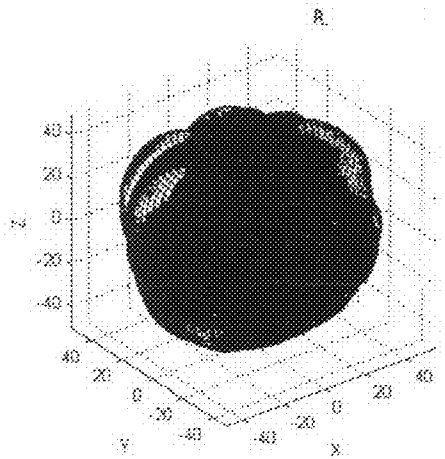
FIG. 16
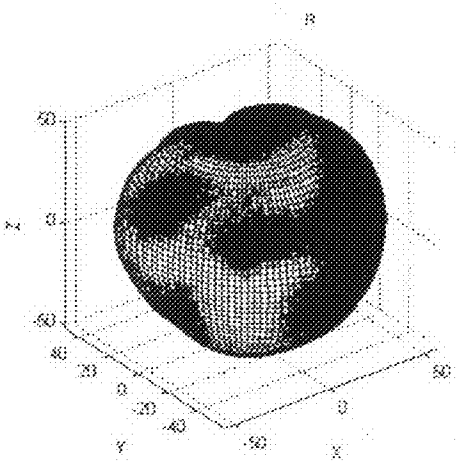
FIG. 15
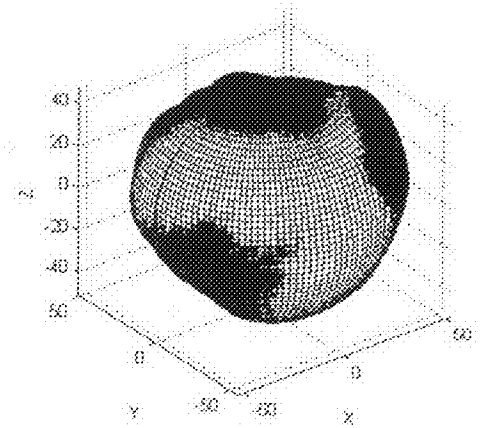
FIG. 18
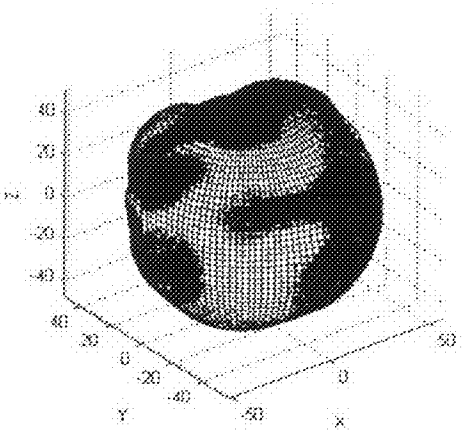
FIG. 17
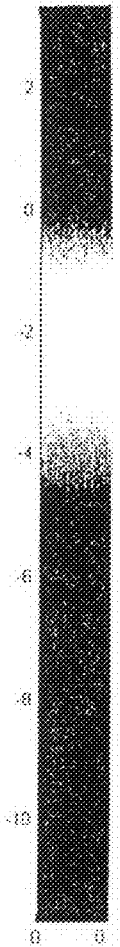

011705 - 2400 - 2485 MHz Monopole_un 2 - 2450 bt, RH.pol
011705 - 2400 - 2485 MHz Monopole_un 2 - 2450 bt, LH.pol

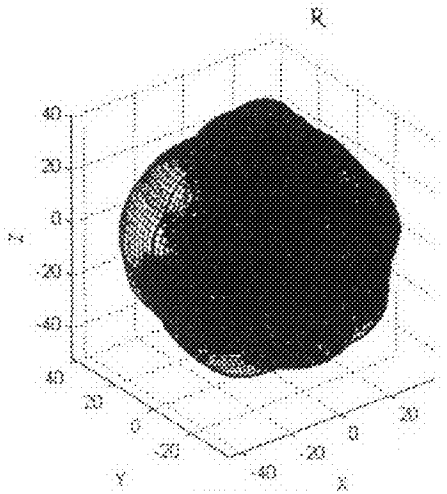
FIG. 28
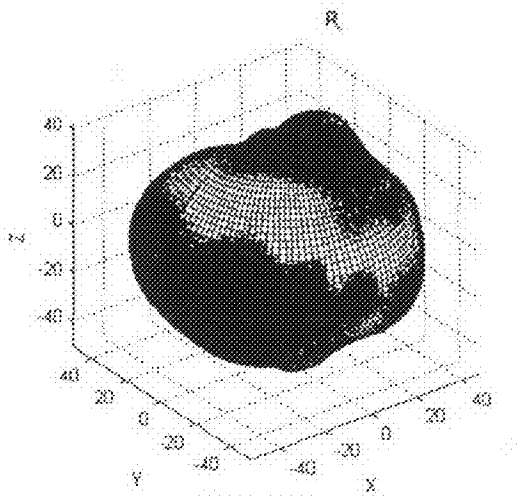
FIG. 27
011705 - 402 - 408 MHz Monopole$_R$_un 2 - 465 bd, RH pol
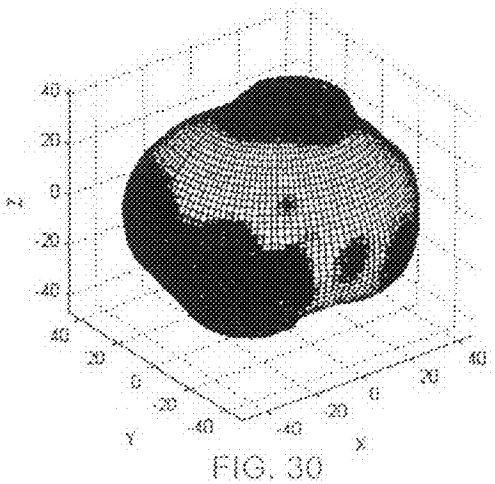
FIG. 30
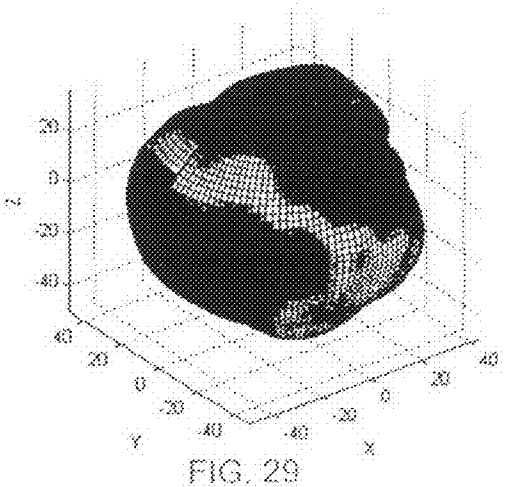
FIG. 29
011705 - 402 - 408 MHz Monopole$_R$_un 2 - 465 bd, Lin pol
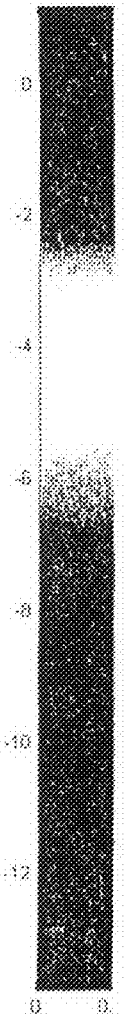

ANTENNA SYSTEM

This application is a Continuation of International Application Number PCT/US2006/004779, filed Feb. 13, 2006, which claims the benefit of the filing date of U.S. Provisional Application Ser. No. 60/651,627 filed Feb. 11, 2005, which is incorporated by reference herein.

BACKGROUND OF THE INVENTION

1. Field of the Invention

The present invention relates to antenna systems. In particular, the invention relates to broadband omni directional antenna systems.

2. Description of Related Art

Known omni directional systems radiate to provide 360 degree coverage on a plane with elevations plus or minus of the plane. Very few truly omni directional antenna systems are known to create coverage in three dimensions on a unit sphere. Difficulties are encountered that include, for example, the feed point through the sphere causes distortion of the radiation pattern, metal structures near the antenna cause reflections that distort the radiation pattern, and the individual radiating element of an antenna inherently does not produce a spherical radiation pattern. In addition, providing a spherical radiation pattern over a broad band of frequencies can be extremely difficult. Antenna structures intended to shape the radiation pattern at one frequency can cause distortion in the radiation pattern at another frequency.

SUMMARY OF THE INVENTION

An antenna system includes plural antennas. Each antenna is different than every other antenna. Each antenna is characterized by a principal plane. A principal plane of a first antenna is oblique to a principal plane of a second antenna. The first antenna includes a first insulating substrate extending in the principal plane of the first antenna. The first antenna further includes a first radiating element and a connected first conductor and includes a second radiating element and a connected second conductor. The first antenna further includes a coupling conductor coupling the second radiating element and the first conductor. The first antenna further includes a first coupler having a first signal conductor and a second signal conductor. The first signal conductor is coupled to the second conductor, and the second signal conductor is coupled to the first radiating element.

BRIEF DESCRIPTION OF DRAWINGS

The invention will be described in detail in the following description of preferred embodiments with reference to the following figures.

FIGS. 11 and 12 are views of a three dimensional representation of a first measured radiation pattern of the antenna system depicted in FIGS. 7 and 8 over the frequency band 300 MHz to 500 MHz for right hand circular polarization and left hand circular polarization, respectively.

FIGS. 13 and 14 are views of a three dimensional representation of a second measured radiation pattern of the antenna system depicted in FIGS. 7 and 8 over the frequency band 300 MHz to 500 MHz for right hand circular polarization and left hand circular polarization, respectively.

FIGS. 15 and 16 are views of a three dimensional representation of a first measured radiation pattern of the antenna system depicted in FIGS. 7 and 8 over the frequency band 800 MHz to 1,000 MHz for right hand circular polarization and left hand circular polarization, respectively.

FIGS. 17 and 18 are views of a three dimensional representation of a second measured radiation pattern of the antenna system depicted in FIGS. 7 and 8 over the frequency band 800 MHz to 1,000 MHz for right hand circular polarization and left hand circular polarization, respectively.

FIGS. 27 and 28 are views of a three dimensional representation of a first measured radiation pattern of the antenna system depicted in FIGS. 7 and 8 over the frequency band 462 MHz to 468 MHz for right hand circular polarization and left hand circular polarization, respectively.

FIGS. 29 and 30 are views of a three dimensional representation of a second measured radiation pattern of the antenna system depicted in FIGS. 7 and 8 over the frequency band 462 MHz to 468 MHz for right hand circular polarization and left hand circular polarization, respectively.

DETAILED DESCRIPTION OF PREFERRED EMBODIMENTS

Figure 2:
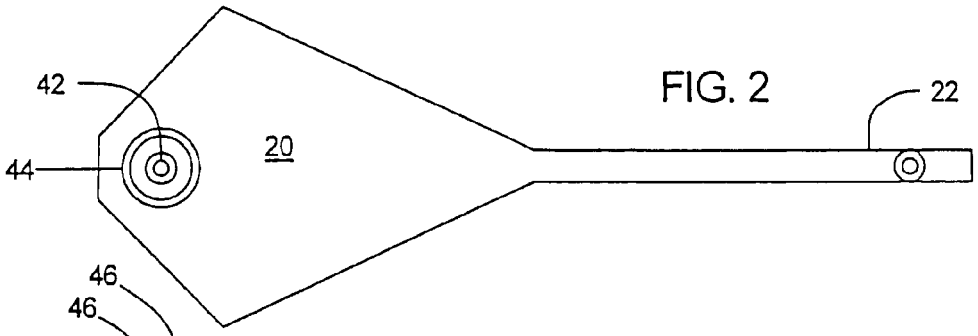
FIGS. 2 and 3 are plan views of the antenna of FIG. 1 from the obverse and reverse sides, respectively.
Figure 1:
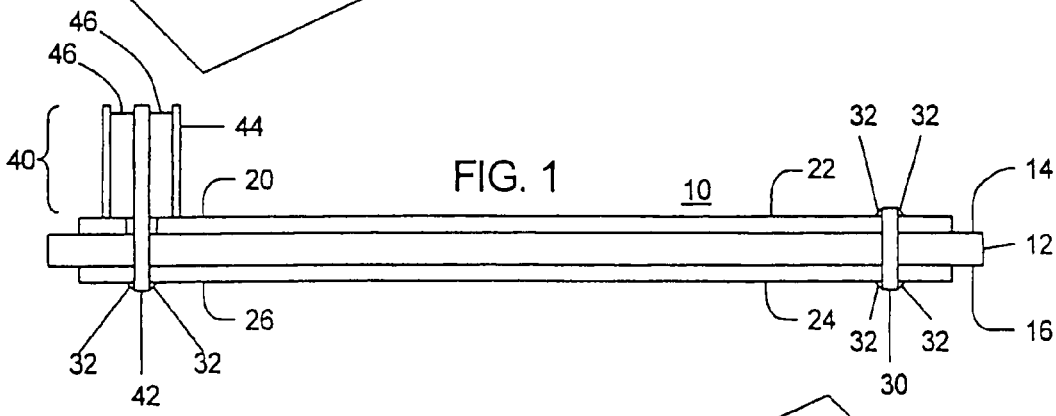
FIG. 1 is a sectional view of an antenna as might be used in an embodiment of an antenna system according to the invention.
Figure 3:
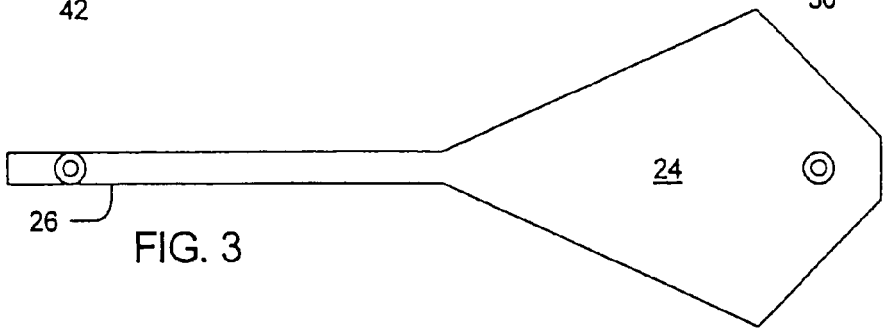

In FIGS. 1-3, an antenna 10 includes a planar shaped insulating substrate 12 extending in a principal plane of the antenna. Insulating substrate 12 has an obverse side 14 and a reverse side 16. The antenna 10 further includes a first radiating element 20 and a connected first conductor 22 disposed on the obverse side 14 and also includes a second radiating element 24 and a connected second conductor 26 disposed on the reverse side 16. The antenna 10 further includes a coupling conductor 30 that couples the second radiating element 24 and the first conductor 22. The antenna 10 further includes a coupler 40 having a first signal conductor 42 and a second signal conductor 44. The first signal conductor 42 is coupled to the second conductor 26, and the second signal conductor 44 is coupled to the first radiating element 20.

In operation and as depicted in FIGS. 1-3, applied currents flow from signal conductor 42 through conductor 26, through radiating element 24, through coupling conductor 30, through conductor 22, through radiating element 20 to conductor 44. When the currents are RF signal currents, at a broad bandwidth about certain frequencies, radiating elements 20 and 24 tend to resonate and operate as an antenna. The radiation that emanates from a radiating element tend to emanate from the edge of the element (e.g., the edge of the etched copper, generally flat, shape).

Antenna 10 has a shape similar to a "bow tie" antenna, and it functions as a broad band antenna. The two halves of the "bow tie" are preferably disposed on opposite sides of the insulating substrate 12, but may, in other variations, be formed on the same side. Antenna 10 is preferably fed from an end point instead of a center point as is common with "bow tie" style antennas. However, in other variations, antenna 10 may be fed from other point, such as the center. In one variation of this antenna, the entire antenna is formed from a double sided copper clad epoxy-glass printed wiring board. In such case, conductor 30 is typically a plated through hole, but may be a rivet or pin held in place by solder filets 32 as depicted in FIGS. 1-3. Other manufactures of the same structure are equivalent. The coupler 40 may be an SMC connector, a BNC connector or other connector suitable at RF frequencies. Typically, the coupler 40 will have insulating dielectric material between conductor 42 and conductor 44.

Figure 4:
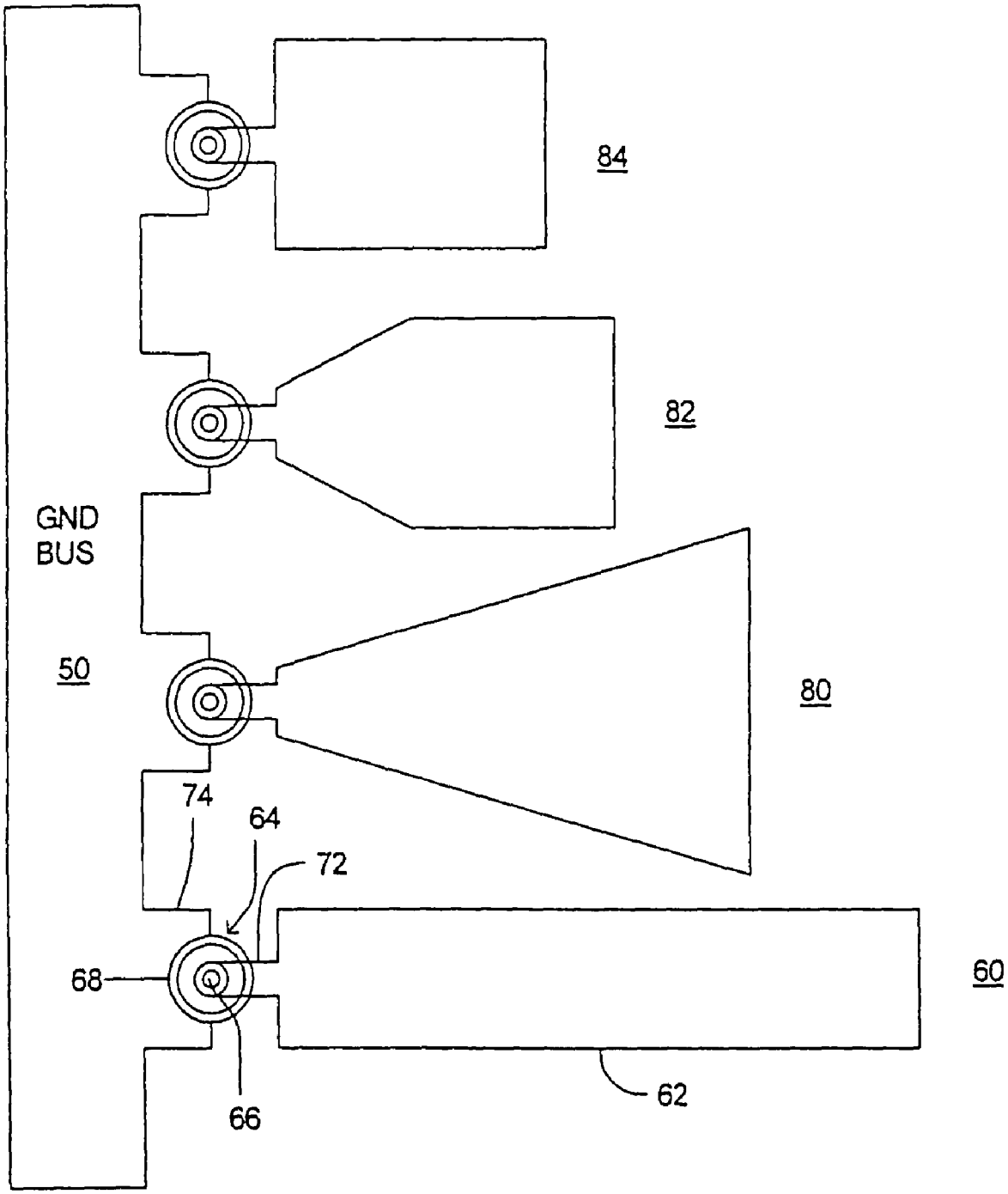
FIG. 4 is a plan view of several antennas as might be used in an embodiment of the antenna system according to the invention.

In FIG. 4, plural antennas are depicted. These antennas are formed on a planar shaped insulating substrate extending in a principal plane of the plural antennas. Each antenna is formed from conductive material, preferably copper, disposed on an obverse side of the insulating substrate. Antenna 60 includes an antenna radiating element 62 and at least a portion a ground conductor 50 (also referred to as ground bus 50) disposed on the obverse side of the insulating substrate. Antenna 60 further includes a coupler 64 having a first signal conductor 66 and a second signal conductor 68. A feed connects coupler 64 to ground conductor 50 and antenna radiating element 62. In particular, the first signal conductor 66 of the coupler 64 is coupled through a first feed portion 72 to the radiating element 62, and the second signal conductor 68 of the coupler 64 is coupled through a second feed portion 74 to the ground conductor 50.

In operation, applied RF signal currents fed through coupler 64 pass though feed portions 72, 74 into ground bus 50 and radiating element 62. From there, electric fields extend between ground bus 50 and the radiating element 62 in such a way to cause RF signals to radiate from antenna 60.

In alternative embodiments, any one or more of antennas 80, 82 and 84 are similarly formed on the same insulating substrate. Each alternative antenna embodiment is varied by size and shape to meet frequency requirements and impedance matching requirements according to "patch radiator" technology. The size and shape of the feed portions 72, 74 are defined to match impedances from the coupler 64 to the radiating element of the antenna.

Figure 5:
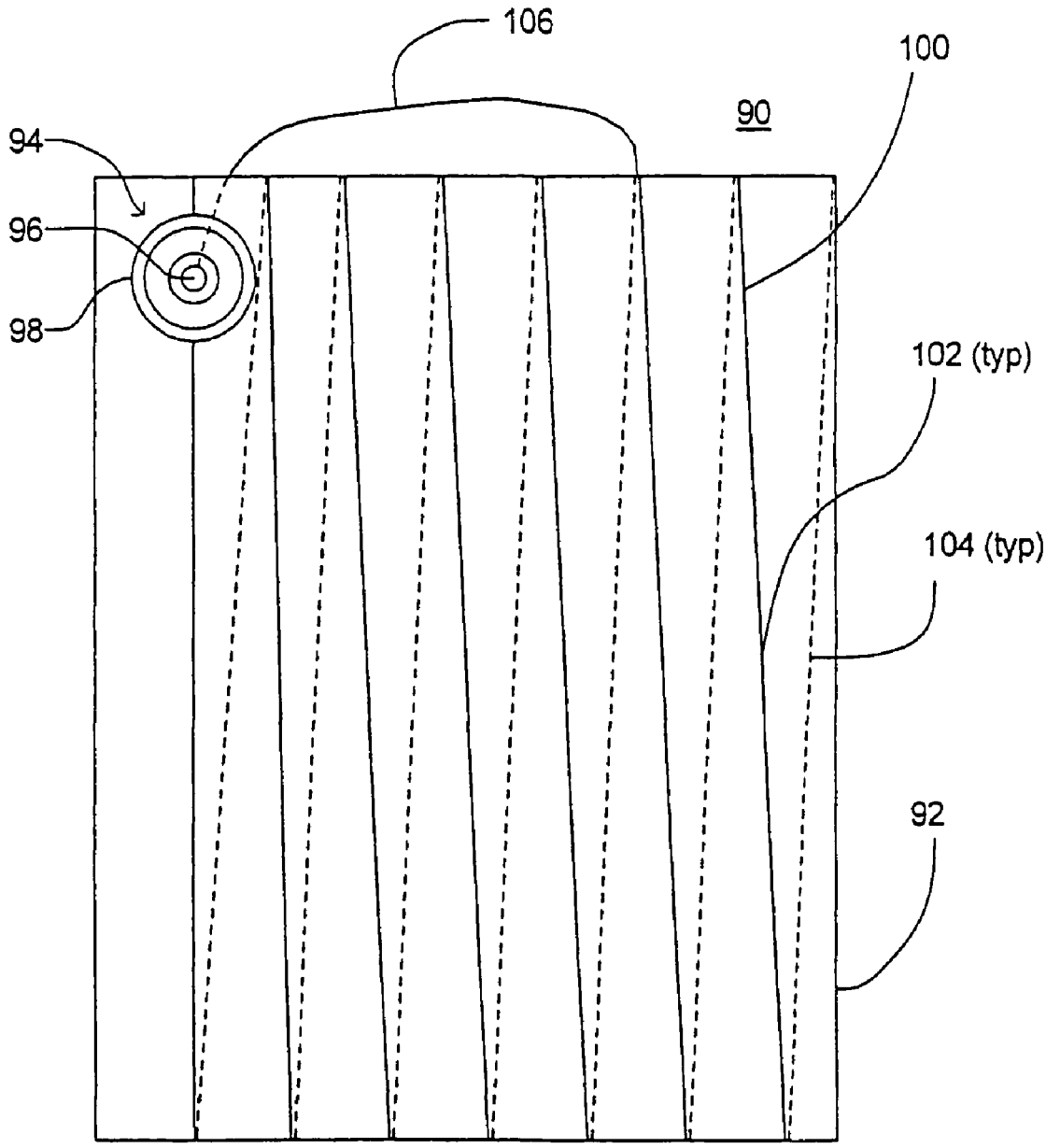
FIG. 5 is a plan view of another antenna as might be used in an embodiment of the antenna system according to the invention.
Figure 6:
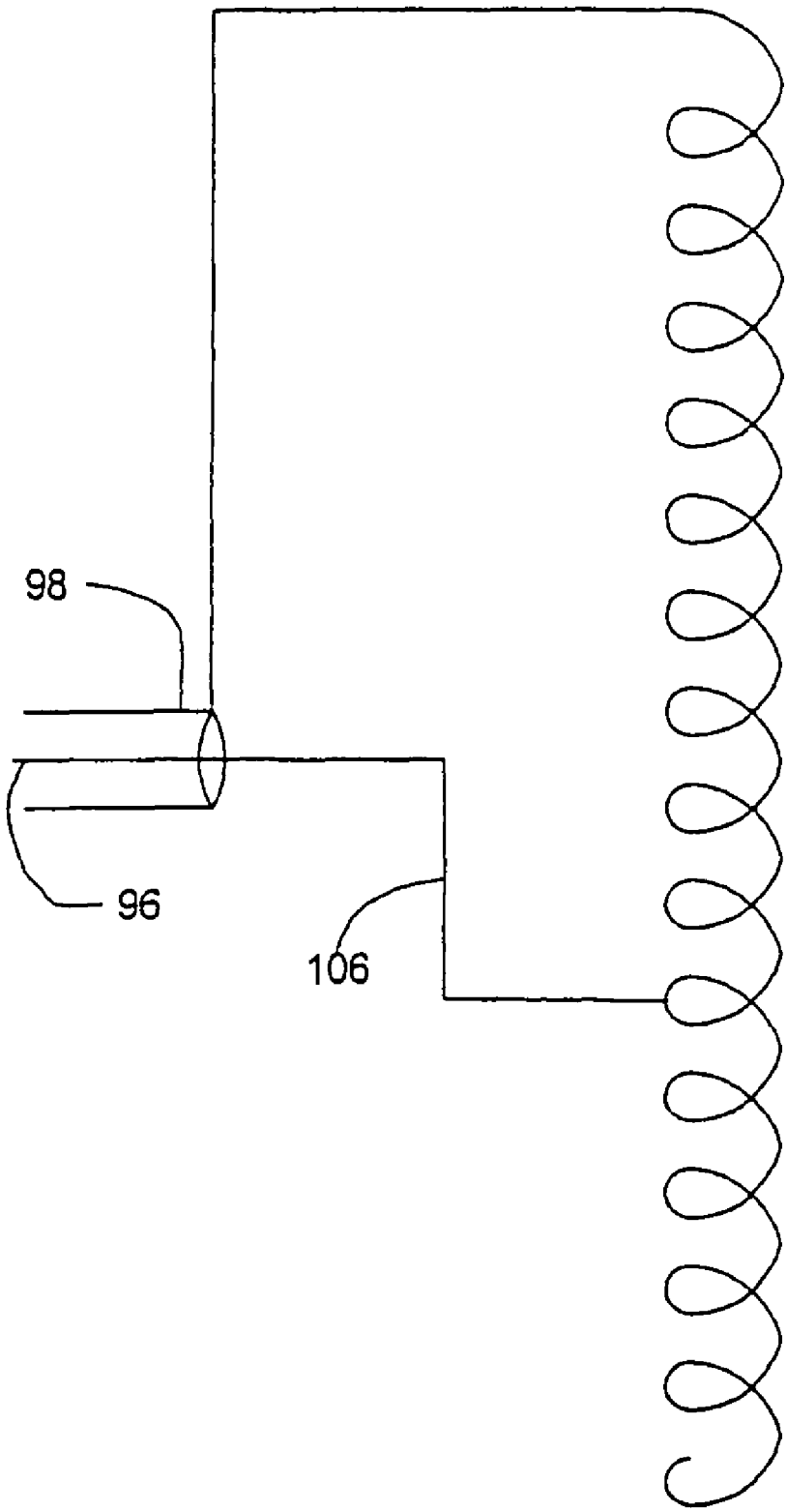
FIG. 6 is a schematic diagram of the antenna of FIG. 5.

In FIGS. 5-6, an antenna 90 includes a planar shaped insulating substrate 92 extending in a principal plane of the antenna. Insulating substrate 92 has an obverse side and a reverse side. Antenna 90 further includes a coupler 94 having a first signal conductor 96 and a second signal conductor 98. Antenna 90 further includes a wire 100 wound in plural turns around the insulating substrate 92. One half of each turn (collectively 102) extends across the obverse side of the substrate, and the other half of each turn (collectively 104) extends across the reverse side of the substrate. In an example of antenna 90, there are 32 turns in the winding. In one example, wire 100 is a wire having a diameter defined by an American Wire Gauge number selected from a range that vary from AWG 18 to AWG 30. If greater current is anticipated, AWG 16 wire might be used. Alternatively, other forms of conductor wires might be used; for example, the wire may be a flat ribbon conductor. The insulating substrate 92 might be an epoxy-glass substrate double clad with copper conductor and etched to form half turns 102 on the obverse side and half turns 104 on the reverse side. The ends of the half turns on the obverse side are connected to the ends of the half turns on the reverse side with plated through holes, rivets, pins or other through conductors as discussed with respect to FIGS. 1-3.

Antenna 90 further includes a tap conductor 106 coupled between the first signal conductor 96 of coupler 94 and a predetermined one of the plural turns of the wire 100. The predetermined turn number is determined during early design stages and may be easily defined by trying several different turn numbers and measuring the antenna's performance. A first end of the plural turns of wire 100 is coupled to the second signal conductor 98.

In operation, applied RF signal currents fed through coupler 94 pass though conductor 96, through tap wire 106 to the predetermined one of the plural turns of wire 100, and from there through a portion of wire 100 to the first end of wire 100 to conductor 98.

Figure 7:
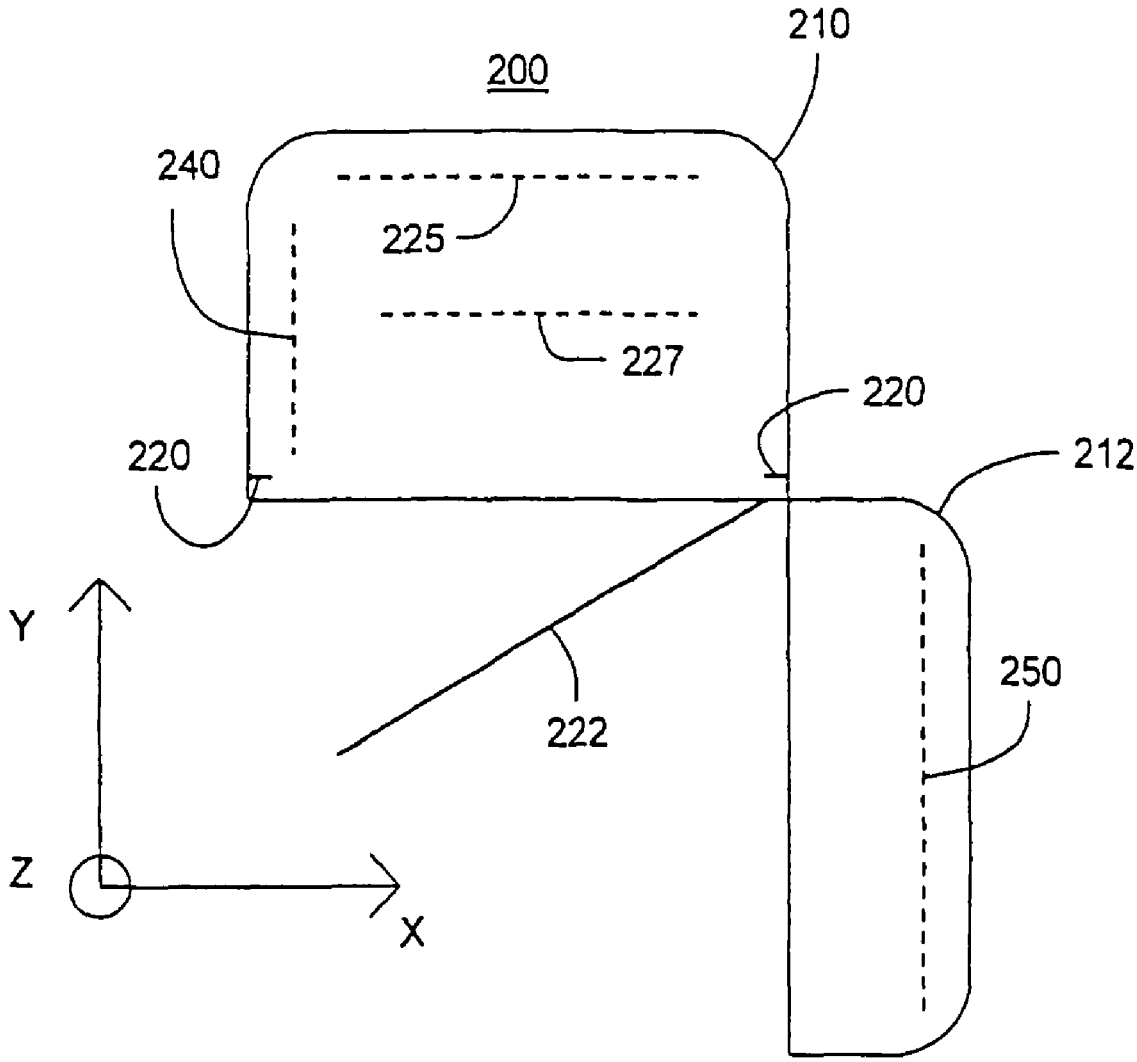
FIGS. 7 and 8 are two orthogonal views of an embodiment of an antenna system according to the invention.
Figure 8:
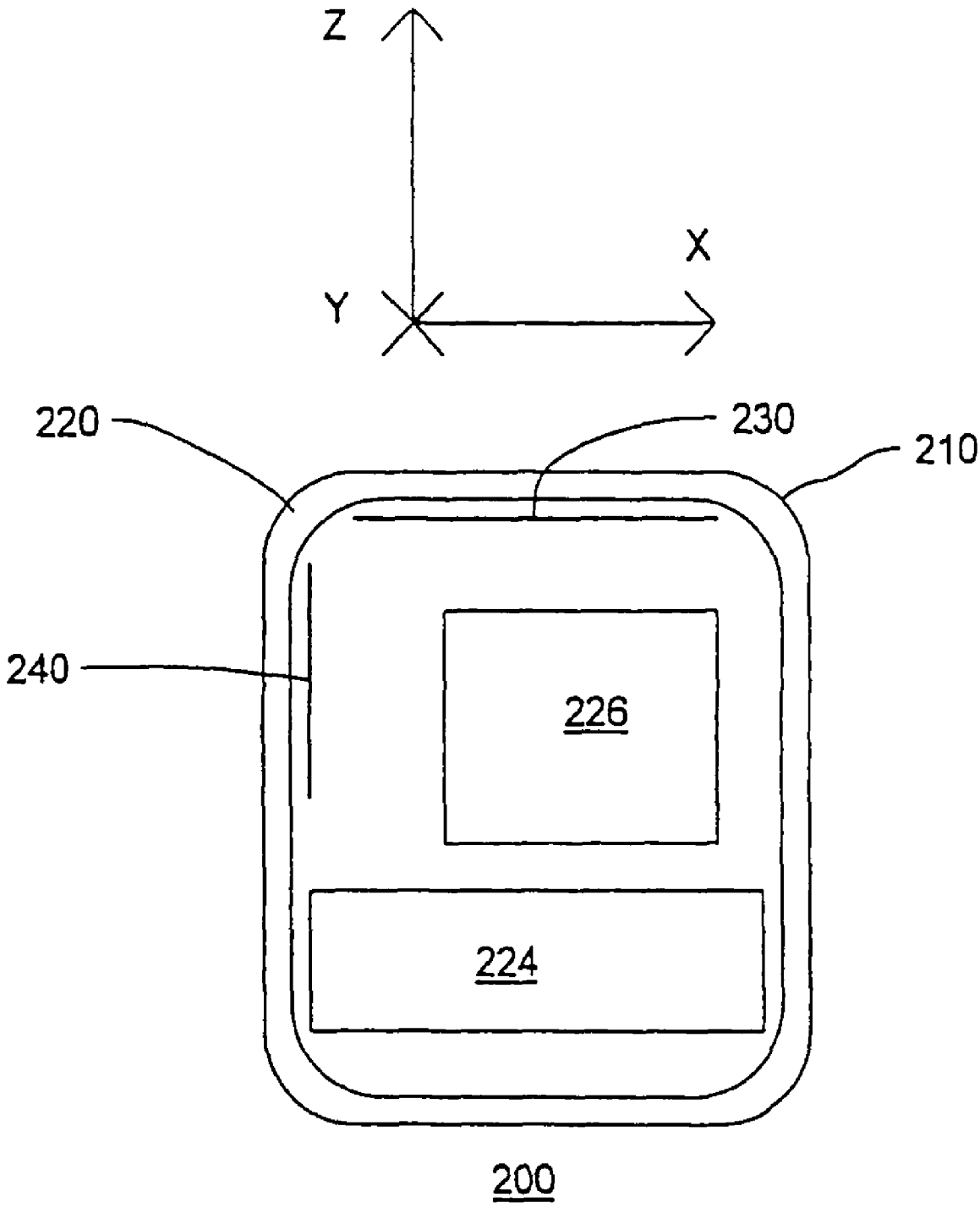

In FIGS. 7-8 an antenna system 200 is depicted. Antennas are mounted within portable case 210 and lid 212. Additionally, conductive control panel 222 is mounted to case 210, preferably by hinges: The case and lid are formed from a non-conductive material such as high impact resistant plastic or rubber. A conductive grounding ring 220 is installed inside the case. Electronic modules 224 and 226 are also installed in the case. Electronic module 224 has an equivalent conductive plane 225, and electronic module 226 has an equivalent conductive plane 227.

The electronic modules may be placed in locations other than those depicted in FIGS. 7 and 8; however, since their equivalent conductive plane may operate as a partial ground plane and reflect RF signals radiated from the antennas, the location of the electronic modules must be taken into account at the time of the design of antenna system 200. Different size, weight, cooling, RF signal and battery power requirements may be imposed on antenna system 200, depending on the application. Therefore, the locations depicted in FIGS. 7 and 8 should be regarded as a starting point and the locations and specific antenna parameters are adjusted to meet imposed requirements.

In a first embodiment of an antenna system, the antenna system includes plural antennas. Each antenna is different than every other antenna, and each antenna is characterized by a principal plane. A principal plane of a first antenna 230 is oblique to a principal plane of a second antenna. The second antenna may be located and oriented as depicted by antenna 240 or 250 in FIGS. 7-8. Much as is described with respect to the antenna depicted in FIGS. 1-3, the first antenna 230 includes a first insulating substrate extending in the principal plane of the first antenna. The first antenna further includes a first radiating element and a connected first conductor and includes a second radiating element and a connected second conductor. The first antenna further includes a coupling conductor coupling the second radiating element and the first conductor. The first antenna further includes a first coupler having a first signal conductor and a second signal conductor. The first signal conductor is coupled to the second conductor, and the second signal conductor is coupled to the first radiating element. The first antenna 230 is not shown in FIG. 7 for clarity, but FIG. 8 depicts an end view of the first antenna 230. The principal plane of the first antenna 230 extends in the X and Y directions. The principal planes of the first and second antennas are oblique; however, in some variants, the planes are substantially orthogonal.

In a first variant of the first embodiment of the antenna system, the second antenna is located and oriented as antenna 240 in FIGS. 7-8. Much as is described with respect to the antenna depicted in FIG. 4, second antenna 240 includes a second insulating substrate extending in the principal plane of the second antenna. The second antenna further includes a second antenna radiating element, a ground conductor, a second coupler and a feed. The second coupler includes a first signal conductor and a second signal conductor. The first signal conductor of the second coupler is coupled to the second antenna radiating element, and the second signal conductor of the second coupler is coupled to the ground conductor. The principal plane of the second antenna 240 extends in the Z and Y directions.

In an example of the first variant of the first embodiment of the antenna system and much as is described with respect to the antenna depicted in FIG. 5, the plural antennas further include a third antenna, and the third antenna 250 includes a third insulating substrate extending in a principal plane of the third antenna. The third antenna further includes a third coupler having first and second signal conductors. The third antenna further includes a wire wound in plural turns around the third insulating substrate and having a first end coupled to the second signal conductor. The third antenna further includes a tap conductor coupled between the first signal conductor and a predetermined one of the plural turns of the wire. The principal plane of the third antenna 250 extends in the Z and Y directions.

In a first mechanization, the principal planes of the first and third antennas 230, 250 are oblique; and possibly substantially orthogonal.

In an example of the first mechanization, the principal planes of the second and third antennas 240, 250 are substantially parallel.

In a second mechanization, the principal planes of the second and third antennas 240, 250 are substantially parallel.

In a second variant of the first embodiment of the antenna system, the second antenna is located and oriented as antenna 250 in FIGS. 7-8. Much as is described with respect to the antenna depicted in FIG. 5, second antenna 250 includes a planar shaped second insulating substrate extending in the principal plane of the second antenna. The second antenna further includes a second coupler having first and second signal conductors. The second antenna further includes a wire wound in plural turns around the second insulating substrate and having a first end coupled to the second signal conductor. The second antenna further includes a tap conductor coupled between the first signal conductor and a predetermined one of the plural turns of the wire. The principal plane of the second antenna 250 extends in the Z and Y directions.

In a second embodiment of an antenna system, the antenna system includes plural antennas. Each antenna is different than every other antenna, and each antenna is characterized by a principal plane. A principal plane of a first antenna is substantially parallel to a principal plane of a second antenna 240. Much as is described with respect to the antenna depicted in FIG. 4, the second antenna 240 includes a planar shaped insulating substrate extending in the principal plane of the second antenna and having an obverse side. The second antenna further includes a radiating element and a ground conductor disposed on the obverse side, a coupler having first and second signal conductors and a feed disposed on the obverse side. The first signal conductor is coupled to the radiating element, and the second signal conductor is coupled to the ground conductor.

In a first variant of the second embodiment of the antenna system, the first antenna is located and oriented as antenna 250 in FIGS. 7-8. Much as is described with respect to the antenna depicted in FIG. 5, first antenna 250 includes a planar shaped first insulating substrate extending in the principal plane of the first antenna. The first antenna further includes a first coupler having first and second signal conductors. The first antenna further includes a wire wound in plural turns around the first insulating substrate and having a first end coupled to the first signal conductor. The first antenna further includes a tap conductor coupled between the second signal conductor and a predetermined one of the plural turns of the wire.

In a third embodiment of an antenna system, the antenna system includes plural antennas. Each antenna is different than every other antenna, and each antenna is characterized by a principal plane. A principal plane of a first antenna 250 is oblique to a principal plane of a second antenna. The second antenna may be located and oriented as depicted by antenna 230 in FIGS. 7-8 or other locations. Much as is described with respect to the antenna depicted in FIG. 5, the first antenna 250 includes a first insulating substrate extending in a principal plane of the first antenna. The first antenna further includes a first coupler having first and second signal conductors. The first antenna further includes a wire wound in plural turns around the first insulating substrate and having a first end coupled to the first signal conductor. The first antenna further includes a tap conductor coupled between the second signal conductor and a predetermined one of the plural turns of the wire.

In many variants of the above embodiments, antennas designed substantially similarly to the antenna depicted in FIGS. 1-3, are designed to operate near resonance over a frequency range from 400 MHz to 500 MHz. This band covers an important FRS band at 462 MHz and another band at 434 MHz.

In many variants of the above embodiments, antennas designed substantially similarly to the antenna depicted at 60 in FIG. 4, are designed to operate near resonance over a frequency range from 462 MHz to 474 MHz. This band covers an important FRS band at 462 MHz and another bands at 474 MHz.

In many variants of the above embodiments, antennas designed substantially similarly to the antenna depicted at 80 in FIG. 4, are designed to operate near resonance over a frequency range from 1,800 MHz to 1,900 MHz. This band covers important cell phone bands.

In many variants of the above embodiments, antennas designed substantially similarly to the antenna depicted at 82 in FIG. 4, are designed to operate near resonance over a frequency range from 800 MHz to 900 MHz. This band covers important cell phone bands.

In many variants of the above embodiments, antennas designed substantially similarly to the antenna depicted at 84 in FIG. 4, are designed to operate near resonance over a frequency range from 2,400 MHz to 2,500 MHz. This band covers important cell phone bands.

In many variants of the above embodiments, antennas designed substantially similarly to the antenna depicted in FIG. 5, are designed to operate near resonance over a frequency range from 25 MHz to 200 MHz. This band covers an important data links at 27 MHz and 134 MHz to 138 MHz.

In a jammer operation, the antennas are fed by signal oscillators. While known broadband jammers require noise generators, with the present invention, inexpensive oscillators may be used. It should be noted that spectral purity of the oscillator is not a requirement. Waveforms distorted from pure sinusoidal waveforms merely add to the broadband coverage. The several antennas, located in the near radiation field (i.e., within 5 to 10 wavelengths) from each other, add to the distortion giving rise to a broadband effect. Signals radiated from one antenna excite parasitic resonance in other nearby antennas. The oscillators for a frequency range from 400 MHz to 500 MHz, for a frequency range from 800 MHz to 900 MHz, for a frequency range from 1,800 MHz to 1,900 MHz, and for a frequency range from 2,400 MHz to 2,500 MHz are located in electronic module 226 of FIG. 8. The oscillators for a frequency range from 25 MHz to 200 MHz and for 300 MHz to 500 MHz are located in electronic module 224. Other locations may be equivalent, but the system performance must be checked to ensure proper performance.

The overall antenna system is intended to work with the oscillators to disrupt communications in selected bands. When considering design balancing, the need for portable operation and long battery life gives rise to a need for low transmit power. However, high transmit power is generally needed to jam a data link. Long battery life is best achieved by ensuring that the radiation intensity pattern is efficiently used. Coverage for the system described is intended to be omni directional in three dimensions. Thus, the best antenna pattern is achieved when there are no main lobes with great antenna gain and no notches with below normal antenna gain. For at least this reason, placement of the antennas and all conductive elements (e.g., electronic modules 224 and 226) are very important, a requirement that become all the more difficult when another requirement of broadband jamming is required in selected bands.

The antenna system of FIGS. 7 and 8 was tested and measurements taken a various frequencies, polarizations and angles over the unit sphere. The measurement results were plotted and are reproduced in three dimension in FIGS. 11-30.

Figure 9:
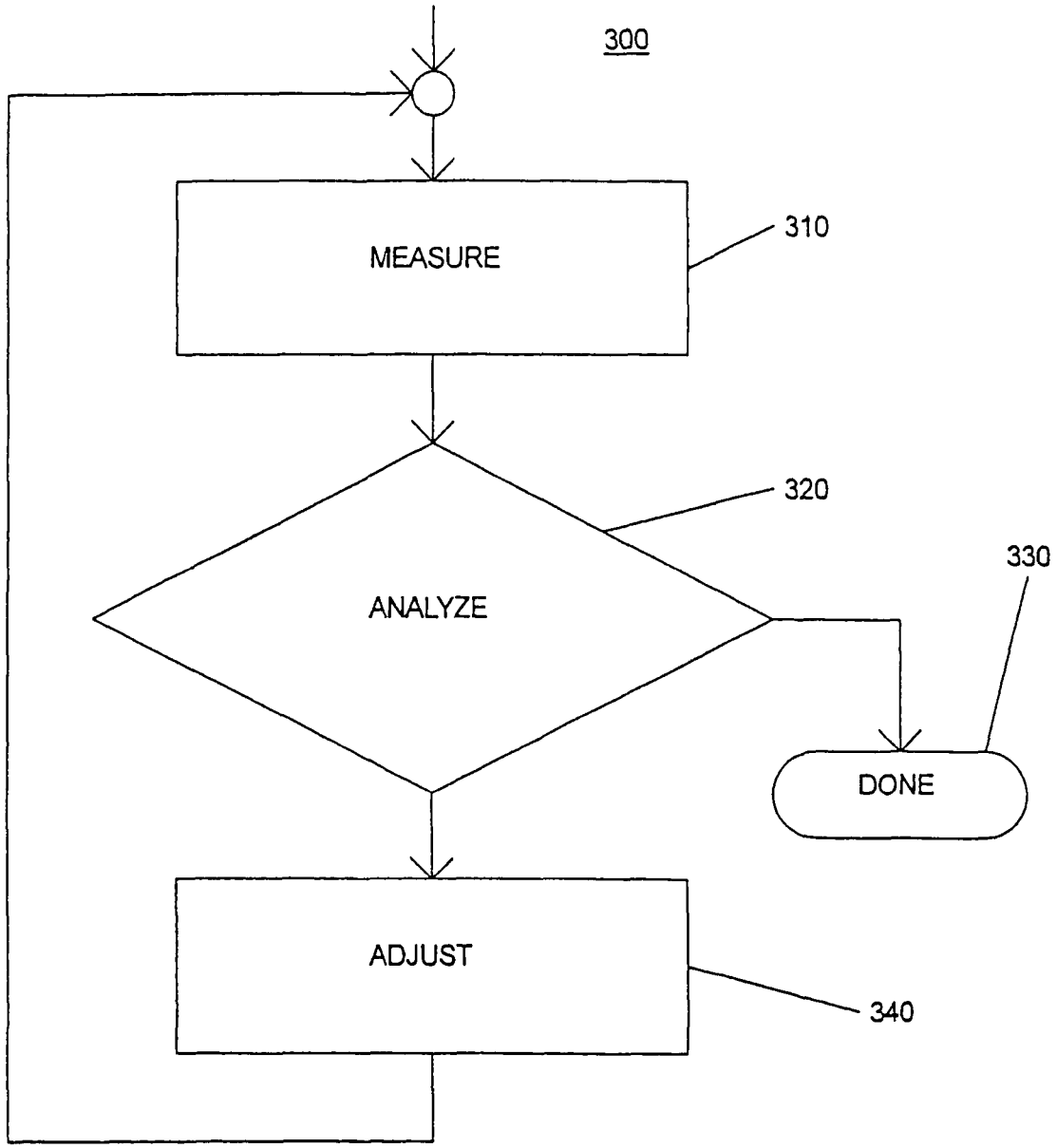
FIG. 9 is a flow chart of an embodiment of a process to tune an antenna system according to the invention.

To meet these stringent requirements, the design process 300 includes measuring performance, analyzing the results and adjusting the antennas' location, orientation and individual antenna design. In FIG. 9, the performance is measured at 310. The performance is measured in terms of antenna gain at angular intervals over an entire unit sphere. At each angular measurement point, the gain is measured at each frequency of interest for the design. The measured performance is analyzed at 320. If the gain is adequate at each angular position and at each frequency of interest, then the design is correctly adjusted and the design process is done at 330. If the performance is inadequate at either a spatial point or at a spectral point (i.e., a frequency point), then the design is adjusted at 340.

Figure 10:
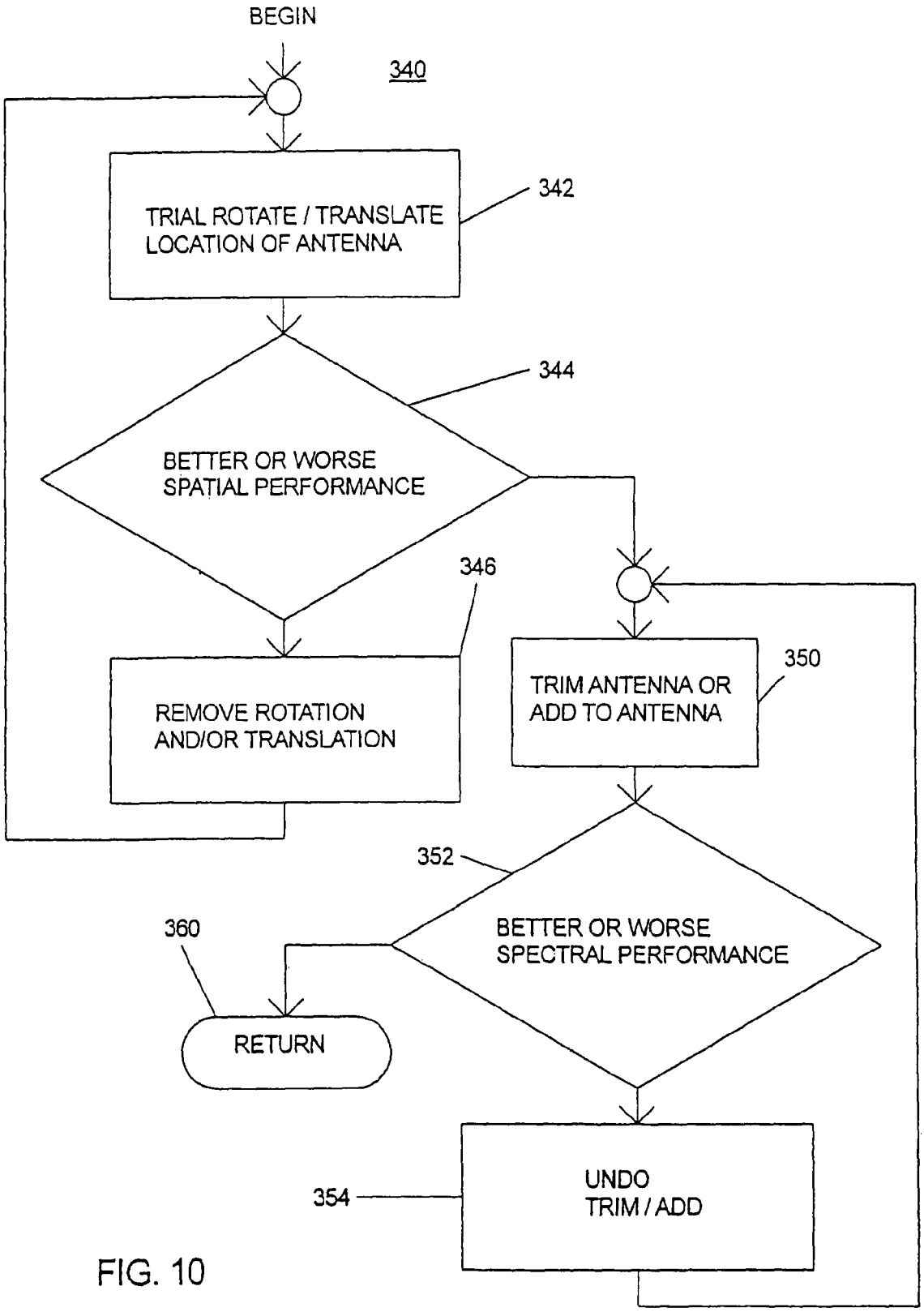
FIG. 10 is a flow chart of an embodiment of the adjust process of FIG. 9.
Figures 19, 20, 21, 22:
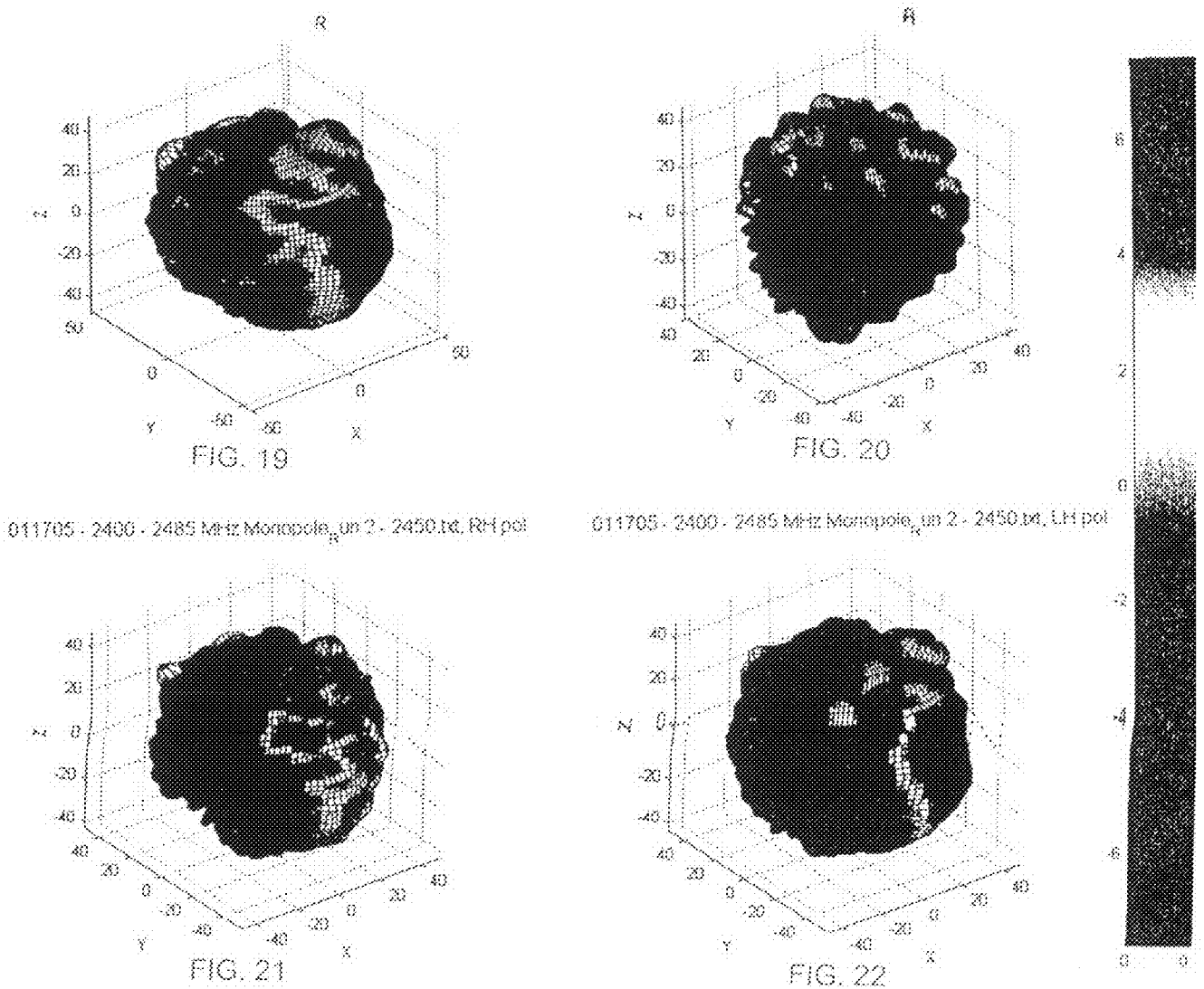
FIGS. 19 and 20 are views of a three dimensional representation of a first measured radiation pattern of the antenna system depicted in FIGS. 7 and 8 over the frequency band 2,400 MHz to 2,485 MHz for right hand circular polarization and left hand circular polarization, respectively.
FIGS. 21 and 22 are views of a three dimensional representation of a second measured radiation pattern of the antenna system depicted in FIGS. 7 and 8 over the frequency band 2,400 MHz to 2,485 MHz for right hand circular polarization and left hand circular polarization, respectively.
Figures 23, 24, 25, 26:
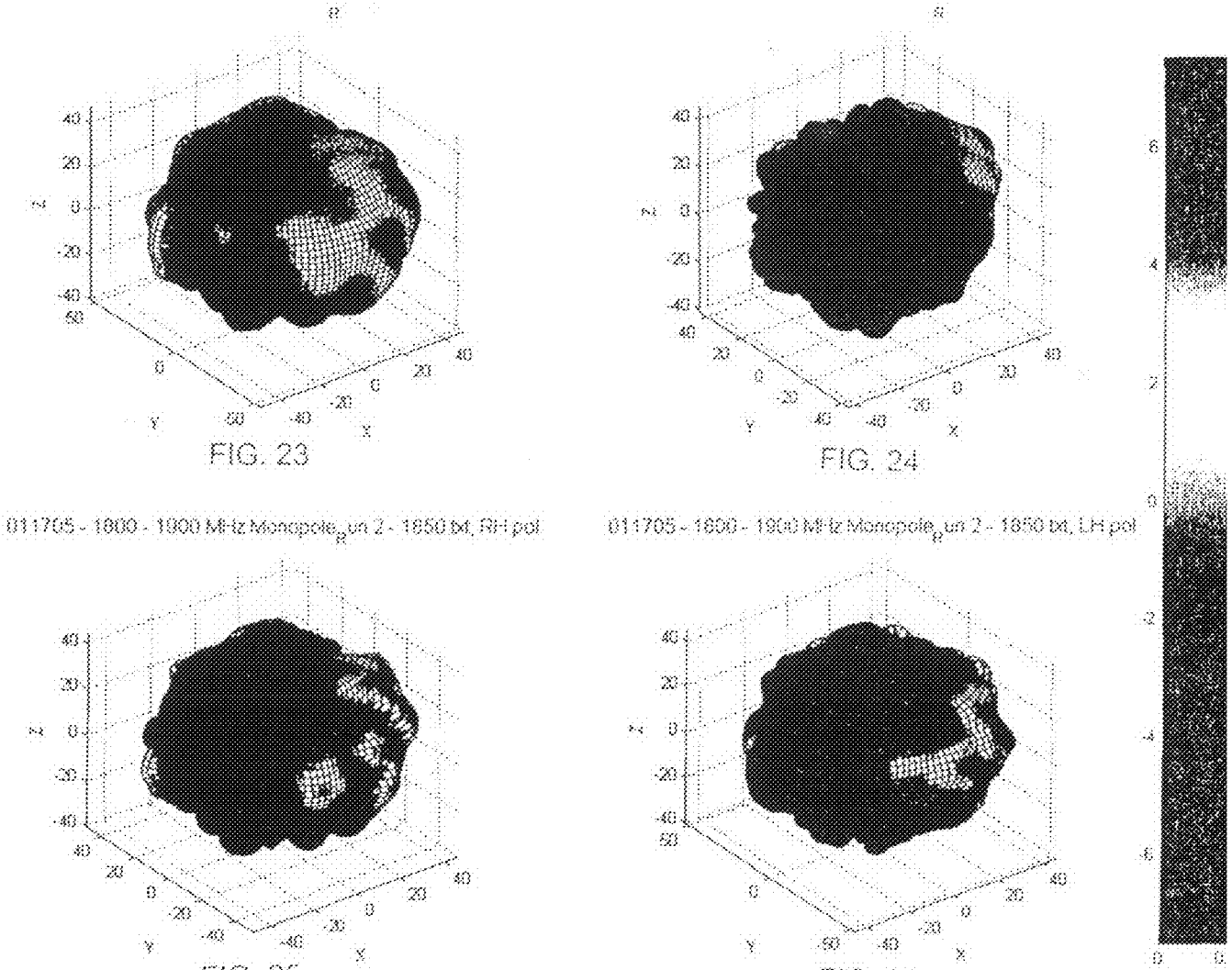
FIGS. 23 and 24 are views of a three dimensional representation of a first measured radiation pattern of the antenna system depicted in FIGS. 7 and 8 over the frequency band 1,800 MHz to 1,900 MHz for right hand circular polarization and left hand circular polarization, respectively.
FIGS. 25 and 26 are views of a three dimensional representation of a second measured radiation pattern of the antenna system depicted in FIGS. 7 and 8 over the frequency band 1,800 MHz to 1,900 MHz for right hand circular polarization and left hand circular polarization, respectively.

In FIG. 10, the design adjustment process 340 is depicted. If the gain is inadequate at a spatial point, a trial relocation or rotation of an antenna is attempted 342. The performance is measured and a decision is made at 344 as to whether the spatial performance (i.e., antenna pattern) is better or worse. If the spatial performance is worse, the rotation and/or translation is removed at 346 and a new try is made at 342. In this instance, better means that the spatial performance at one required frequency is met. If the performance is better as tested at 344, then the antennas are adjusted. Beginning with the antenna that has the best performance as measured by gain uniformity over the frequency band, the antenna is adjusted at 350 by trimming the size of the antenna or adding to the size of the antenna. Typically, this is done by trimming a copper clad epoxy-glass substrate with a sharp knife or by adding conductive foil to extend the size of the antenna. This process may be guided by known antenna design techniques. Once adjusted, the antenna is tested for spectral uniformity at 352, and if the uniformity requirement is not yet met, the trim/add is undone at 354 and the adjusting of the antenna is done again. After one antenna is adjusted, the next antenna in the antenna system is similarly adjusted until all antennas provide a suitable uniform spectral response, at which time, the adjustment process 340 is done at 360.

In FIG. 9, after the adjustment process 340 is completed a new measurement is made at 310 and analyzed at 320. This process is repeated until done at 330.

Having described preferred embodiments of a novel antenna system and method of making an antenna system (which are intended to be illustrative and not limiting), it is noted that modifications and variations can be made by persons skilled in the art in light of the above teachings. It is therefore to be understood that changes may be made in the particular embodiments of the invention disclosed which are within the scope of the invention as defined by the appended claims.

Having thus described the invention with the details and particularity required by the patent laws, what is claimed and desired protected by Letters Patent is set forth in the appended claims.

What is claimed is:

1. An antenna system comprising plural antennas, wherein:
each antenna is different than every other antenna;
each antenna is characterized by a principal plane;
a principal plane of a first antenna is oblique to a principal plane of a second antenna;
the first antenna includes a first insulating substrate extending in the principal plane of the first antenna;
the first antenna further includes a first radiating element and a connected first conductor and includes a second radiating element and a connected second conductor;
the first antenna further includes a coupling conductor coupling the second radiating element and the first conductor;
the first antenna further includes a first coupler having a first signal conductor and a second signal conductor;
the first signal conductor is coupled to the second conductor; and
the second signal conductor is coupled to the first radiating element.

2. An antenna system according to claim 1, wherein:
the second antenna includes a second insulating substrate extending in the principal plane of the second antenna;
the second antenna further includes a second antenna radiating element, a ground conductor, a second coupler and a feed;
the second coupler includes a first signal conductor and a second signal conductor;
the first signal conductor of the second coupler is coupled to the second antenna radiating element; and
the second signal conductor of the second coupler is coupled to the ground conductor.

3. An antenna system according to claim 2, wherein:
the plural antennas include a third antenna;
the third antenna includes a third insulating substrate extending in a principal plane of the third antenna;
the third antenna further includes a third coupler having first and second signal conductors;

the third antenna further includes a wire wound in plural turns around the third insulating substrate and having a first end coupled to the second signal conductor; and the third antenna further includes a tap conductor coupled between the first signal conductor and a predetermined one of the plural turns of the wire.

4. An antenna system according to claim 3 wherein the principal plane of the first antenna is oblique to a principal plane of the third antenna.

5. An antenna system according to claim 4 wherein the principal plane of the second antenna is substantially parallel to the principal plane of the third antenna.

6. An antenna system according to claim 3 wherein the principal plane of the second antenna is substantially parallel to a principal plane of the third antenna.

7. An antenna system according to claim 2, wherein:

the second insulating substrate includes an obverse side;

the second antenna radiating element and the ground conductor are disposed on the obverse side of the second insulating substrate; and the feed is disposed on the obverse side of the second insulating substrate.

8. An antenna system according to claim 1, wherein:

the second antenna includes a planar shaped second insulating substrate extending in the principal plane of the second antenna;

the second antenna further includes a second coupler having first and second signal conductors;

the second antenna further includes a wire wound in plural turns around the second insulating substrate and having a first end coupled to the second signal conductor; and the second antenna further includes a tap conductor coupled between the first signal conductor and a predetermined one of the plural turns of the wire.

9. An antenna system according to claim 1 wherein:

the insulating substrate has an obverse side and a reverse side;

the first radiating element and the connected first conductor are disposed on the obverse side;

the second radiating element and the connected second conductor are disposed on the reverse side; and the coupling conductor couples the second radiating element and the first conductor through the insulating substrate.

10. An antenna system according to claim 1 wherein the antennas are fed by more than one signal oscillator.

11. An antenna system, comprising plural antennas, wherein:

each antenna is different than every other antenna;

each antenna is characterized by a principal plane;

a principal plane of a first antenna is substantially parallel to a principal plane of a second antenna;

the second antenna includes an insulating substrate extending in the principal plane of the second antenna;

the second antenna further includes a radiating element, a ground conductor, a coupler having first and second signal conductors and a feed;

the first signal conductor is coupled to the radiating element; and the second signal conductor is coupled to the ground conductor;

wherein:

the first antenna includes a planar shaped first insulating substrate extending in the principal plane of the first antenna;

the first antenna further includes a first coupler having first and second signal conductors;

the first antenna further includes a wire wound in plural turns around the first insulating substrate and having a first end coupled to the first signal conductor; and the first antenna further includes a tap conductor coupled between the second signal conductor and a predetermined one of the plural turns of the wire.

12. An antenna system comprising plural antennas, wherein:

each antenna is different than every other antenna;

each antenna is characterized by a principal plane;

a principal plane of a first antenna is oblique to a principal plane of a second antenna;

the first antenna includes a first insulating substrate extending in a principal plane of the first antenna;

the first antenna further includes a first coupler having first and second signal conductors;

the first antenna further includes a wire wound in plural turns around the first insulating substrate and having a first end coupled to the first signal conductor; and the first antenna further includes a tap conductor coupled between the second signal conductor and a predetermined one of the plural turns of the wire.

13. A method comprising:

measuring a spatial performance and a spectral performance of an antenna system;

analyzing the spatial performance and the spectral performance;

adjusting a rotational location or spatial separation of an antenna in the antenna system when the spectral performance fails to meet spectral requirements;

adjusting the antenna in the antenna system when the spectral performance fails to meet spectral requirements, and adjusting within the antenna system by spatial separation and rotational location in order to achieve spatial and spectral matched performance.

* * * * *